United States Patent [19]

Matthey et al.

[11] 4,413,565

[45] Nov. 8, 1983

[54] PROJECTILE WITH A TUBULAR-SHAPED PROJECTILE BODY

[75] Inventors: Philippe Matthey, Arogno, Switzerland; Robert Salmon, St. Genis, France; Niklaus Bühlmann, Thalwil, Switzerland

[73] Assignee: Werkzeugmaschinenfabrik Oerlikon-Bührle AG, Zurich, Switzerland

[21] Appl. No.: 373,122

[22] Filed: Apr. 29, 1982

[30] Foreign Application Priority Data

May 21, 1981 [CH] Switzerland ..... 3307/81

[51] Int. Cl.[3] ..... F42B 13/16; F42B 11/00

[52] U.S. Cl. ..... 102/503; 102/520

[58] Field of Search ..... 102/501, 503, 520–523, 102/532

[56] References Cited

U.S. PATENT DOCUMENTS

| | | | |
|---|---|---|---|
| 2,386,054 | 10/1945 | McGee . | |
| 3,024,729 | 3/1962 | Kluge | 102/503 |

FOREIGN PATENT DOCUMENTS

| | | |
|---|---|---|
| 398091 | 5/1909 | France . |
| 2365098 | 4/1978 | France . |
| 19912 | of 1893 | United Kingdom . |
| 3921 | of 1905 | United Kingdom . |

*Primary Examiner*—Harold J. Tudor

*Attorney, Agent, or Firm*—Werner W. Kleeman

[57] ABSTRACT

Firing of a tubular-shaped projectile body containing a sharp-edged annular end surface previously created difficulties, because firing the end surface of the tubular-shaped projectile body was damaged by the sabot base portion by virtue of the large acceleration forces. This difficulty is avoided in that the invention contemplates incorporating an at least bipartite ring-shaped wedge member between a cone-shaped portion of the sabot base portion and a cone-shaped rear wall of the tubular-shaped projectile body.

12 Claims, 2 Drawing Figures

22
18
19
12
16
17
15
50
20
14
11
54
21
23
27
a
b
28
10
13
α
β
25
26
24
52

PROJECTILE WITH A TUBULAR-SHAPED PROJECTILE BODY

BACKGROUND OF THE INVENTION

The present invention relates to a new and improved construction of a projectile possessing a substantially tubular-shaped projectile body.

Generally speaking, the projectile of the present development is of the type wherein at the rear end of the tubular-shaped projectile body there is provided at the inside thereof a substantially cone-shaped inner wall or portion which widens or outwardly tapers towards the rear. Additionally, there is provided for the projectile body a sabot base portion upon which bears, during firing of the projectile, the projectile body, the sabot base portion detaching upon departure of the projectile out of the firing weapon. The sabot base portion possesses a substantially cone-shaped portion which likewise enlarges or outwardly tapers towards the rear, this cone-shaped portion protruding from the rear of the projectile body into the cone-shaped portion of such projectile body.

According to a prior art tubular-shaped projectile of this type, for instance as disclosed in German Patent Publication No. 2,454,584, the projectile body is provided at its rear end with a substantially ring-shaped or annular shoulder upon which bears the sabot base portion.

On the one hand, this shoulder is afflicted with the drawback that if it is narrowly constructed then, during firing of the projectile, it is exposed to a large surface compression and, on the other hand, if such soulder has a wide construction then it possesses the drawback that it is unfavourable from the standpoint of aerodynamical considerations.

On the other hand, the cone-shaped portion of the sabot base portion should not bear upon the cone-shaped inner wall of the projectile body, since then the projectile body and the sabot base portion tend to wedge with one another and there is no longer ensured for the proper detachment of the base portion from the projectile body after exit of the projectile out of the firing weapon, since the slope of the conical-shaped inner wall of the projectile body is configured to be self-locking for aerodynamical reasons.

Other constructions of projectiles are disclosed for instance in French Pat. No. 2,365,098, filed Sept. 14, 1977, French Pat. No. 398,091, published May 26, 1909, U. S. Pat. No. 2,386,054, granted Oct. 2, 1945 and British Pat. No. 3921, granted Nov. 23, 1905.

SUMMARY OF THE INVENTION

Therefore, with the foregoing in mind it is a primary object of the present invention to provide an improved construction of projectile which is not afflicted with the aforementioned drawbacks and limitations of the prior art proposals.

Another and more specific object of the present invention aims at precluding damage to the rear edge of the tubular-shaped projectile body, upon firing of the projectile, without the need for reinforcing such rear edge, since such edge is too weak to sustain the large forces arising upon firing of the projectile and, on the other hand, aims at ensuring for a positive release or detachment of the sabot base portion of the projectile body, i.e. preventing that the cone-shaped portion of the sabot base portion will undesirably bind or wedge at the cone-shaped inner wall of the projectile body.

Now in order to implement these and still further objects of the invention which will become more readily apparent as the description proceeds, the projectile of the present development is manifested by the features that between the cone-shaped inner wall of the projectile body and the cone-shaped portion of the sabot base portion there is arranged an at least two-part or bipartite ring-shaped wedge member which is of conical configuration both at its outer surface as well as at its inner surface.

This wedge member affords the advantage that there is ensured for a reliable detachment of the sabot base portion, following the firing of the projectile, and specifically, without there arising the danger of the sabot base portion becoming wedged in the tubular-shaped projectile body.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
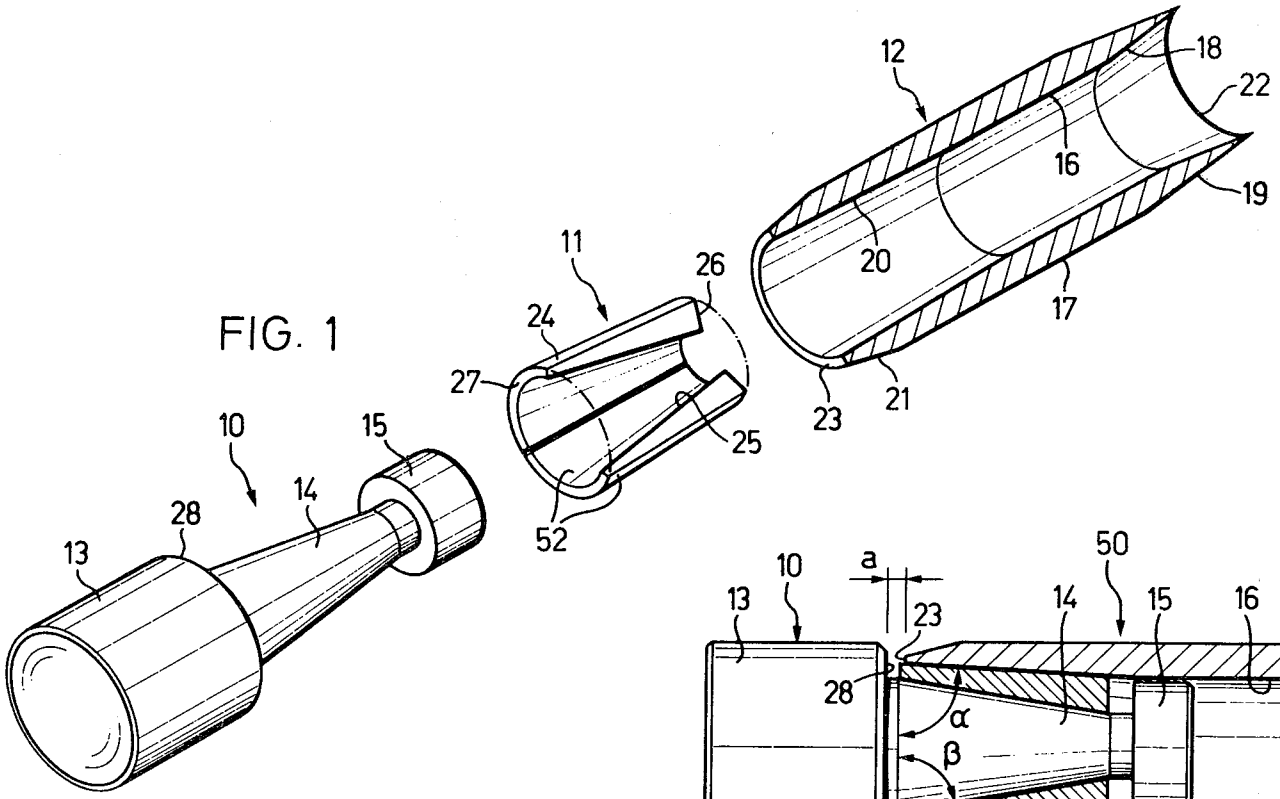
FIG. 1 is an exploded perspective view illustrating individual parts of the projectile according to the invention.
FIG. 2 is a longitudinal sectional view through the projectile illustrated in FIG. 1, but this time showing such projectile with the parts thereof assembled together.

Describing now the drawings, in FIGS. 1 and 2 there has been illustrated an exemplary embodiment of projectile, generally indicated by reference character 50. This projectile 50 contains a sabot base portion 10, a ring-shaped wedge member 11, here shown as a three-part ring-shaped wedge member, and a sbustantially tubular-shaped projectile body 12. The sabot base portion 10—also sometimes simply referred to as the base portion—consists of a cylindrical rear portion or section 13, an intermediate cone-shaped or conical section or portion 14 and a front cylindrical section or portion 15, also referred to as the head portion. The cone-shaped intermediate portion 14 of the base portion 10 is encircled or enclosed by the three-part ring-shaped or annular wedge member 11. The sabot base portion 10 protrudes by means of the head or head portion 15 and the intermediate conical portion 14 into the interior of the tubular-shaped projectile body 12.

Both the inner wall and also the outer wall of the tubular-shaped projectile body 12 consists of three sections or portions, and specifically, a cylindrical inner wall 16, a cylindrical outer wall 17, a forward cone-shaped inner wall 18, a forward cone-shaped outer wall 19, a rear cone-shaped inner wall 20, and a rear cone-shaped outer wall 21. The forward inner wall 18 and the forward outer wall 19 form a sharp edge or pointed edge portion 22. Equally, the rear outer wall 21 and the rear inner wall 20 bound a narrow ring-shaped end surface or region 23.

The three-part ring-shaped or annular wedge member 11 possesses a substantially cone-shaped outer wall 24 and a substantially cone-shaped inner wall 25. Both of these conical walls 24 and 25 delimit at their front region a wider ring-shaped end surface 26 and at their rear region or end a narrower ring-shaped end surface 27. The cone angle $\alpha$ is selected such that the ring-shaped wedge member 11 is inserted in a self-locking fashion within the tubular-shaped projectile body 12. However, the cone angle $\beta$ is selected such that the ring-shaped wedge member 11 does not bear in a self-locking fashion at the conical portion 14 of the sabot base portion 10. Between the ring-shaped end surface 23 of the projectile body 12 and the forward or front end surface 28 of the rear cylindrical portion or section 13 there is provided a spacing a which ensures that the end surface 23 of the projectile body 12, upon firing of the projectile, will not be damaged by the acceleration forces of the projectile body 12. Equally, between the ring-shaped narrower end surface 27 of the ring-shaped wedge member 11 and the front end surface 28 of the rear cylindrical section or portion 13 there is provided a spacing b which ensures that the ring-shaped wedge member 11 correctly bears at the conical-shaped portion or section 14 of the sabot base portion 10.

The smaller cone angle $\beta$ ensures that, following firing of the projectile, the sabot base portion 10 reliably detaches from the projectile body 12, i.e. from the ring-shaped wedge member 11. This ring-shaped or annular wedge member 11 can reliably release from the tubular-shaped projectile body 12, even though the cone angle $\alpha$ is chosen such that the ring-shaped wedge member 11 is inserted in a self-locking fashion within the tubular-shaped projectile body 12.

If there is used an aluminium alloy as is known in this technology for the sabot base portion 10 and for the ring-shaped wedge member 11, then the cone-shaped outer wall 24 and the cone-shaped inner wall 25 of the ring-shaped wedge member 11 can be provided with an oxalic coating or layer, as has merely been generally indicated by reference character 52 in FIG. 1.

Also, between the projectile body 12 and the ring-shaped wedge member 11 as well as between the sabot base portion 10 and the ring-shaped wedge member 11 there can be arranged a plastic layer or a lubricant layer, for instance formed of grease or graphite, as has merely been generally indicated by reference character 54 in FIG. 2.

Also, it is possible to provide an air gap between the parts of the ring-shaped wedge member 11 in order to facilitate the detachment of such multi-part wedge member 11 from the projectile body 12.

While there are shown and described present preferred embodiments of the invention, it is to be distinctly understood that the invention is not limited thereto, but may be otherwise variously embodied and practiced within the scope of the following claims. Accordingly,

We claim:

1. A projectile comprising:

a substantially tubular-shaped projectile body;

said tubular-shaped prjectile body having a rear end provided at an inner surface thereof with a substantially conical-shaped rearwardly widening inner wall defining a conical-shaped portion of the projectile body;

a sabot base portion positioned to cooperate with the rear end of said projectile body;

said projectile body bearing upon said sabot base portion during firing of said projectile;

said sabot base portion detaching from the projectile body upon exit of the projectile out of a firing weapon;

said sabot base portion containing a rearwardly widening substantially conical-shaped portion which extends into the rear end of said conical-shaped portion of the projectile body;

a substantially ring-shaped wedge member formed of at least two wedge parts arranged between said conical-shaped rearwardly widening inner wall of the projectile body and said rearwardly widening conical-shaped portion of the sabot base portion; and said at least two-part ring-shaped wedge member being of conical configuration at an outer surface and at an inner surface thereof.

2. The projectile as defined in claim 1, wherein:

said substantially ring-shaped wedge member possesses a greater thickness at a forward region thereof than at a rearward region thereof; and said projectile body being exclusively supported by means of said ring-shaped wedge member upon said sabot base portion.

3. The projectile as defined in claim 2, wherein:

said ring-shaped wedge member is composed of three wedge parts.

4. The projectile as defined in claim 1, wherein:

said ring-shaped wedge member possesses a substantially conical configuration at an outer surface thereof and at an inner surface thereof and only is constructed to be self-locking with the projectile body at its outer surface.

5. The projectile as defined in claim 4, wherein:

said sabot base portion is provided with a head portion at the region of said rearwardly widening conical-shaped portion thereof; and said head portion serving for removal of the ring-shaped wedge member out of the tubular-shaped projectile body.

6. The projectile as defined in claim 1, wherein:

said projectile body has a ring-shaped end surface; and said projectile body bears by means of the ring-shaped wedge member and by means of said ring-shaped end surface upon the sabot base portion.

7. The projectile as defined in claim 1, wherein:

said sabot base portion is formed of an aluminium alloy;

said conical outer surface of said ring-shaped wedge member defining a cone-shaped outer wall which is covered with an oxalic layer; and said conical inner surface of said ring-shaped wedge member defining a cone-shaped inner wall which is covered with an oxalic layer.

8. The projectile as defined in claim 1, further including:

a respective plastic layer arranged between the projectile body and the ring-shaped wedge member and between said sabot base portion and said ring-shaped wedge member.

9. The projectile as defined in claim 1, further including:

means defining a respective lubricant layer arranged between said projectile body and said ring-shaped wedge member and between said sabot base portion and said ring-shaped wedge member.

10. The projectile as defined in claim 9, wherein:

said lubricant layer is formed of grease.

11. The projectile as defined in claim 9, wherein:

said lubricant layer is formed of graphite.

12. The projectile as defined in claim 1, wherein:

said ring-shaped wedge member is structured such that between said wedge parts there is arranged at least one air gap.

* * * * *